US008731452B2

(12) United States Patent
Moorlag et al.

(10) Patent No.: US 8,731,452 B2
(45) Date of Patent: May 20, 2014

(54) BIONANOCOMPOSITE FUSER TOPCOATS COMPRISING NANOSIZED CELLULOSIC PARTICLES

(75) Inventors: Carolyn Moorlag, Mississauga (CA); Yu Qi, Oakville (CA); Brynn Dooley, Toronto (CA); Qi Zhang, Milton (CA)

(73) Assignee: Xerox Corporation, Norwalk, CT (US)

( * ) Notice: Subject to any disclaimer, the term of this patent is extended or adjusted under 35 U.S.C. 154(b) by 105 days.

(21) Appl. No.: 13/446,267

(22) Filed: Apr. 13, 2012

(65) Prior Publication Data

US 2013/0272763 A1 Oct. 17, 2013

(51) Int. Cl.
*G03G 15/20* (2006.01)

(52) U.S. Cl.
USPC ..... 399/333; 430/124.32

(58) Field of Classification Search
USPC ..... 399/333, 328, 329, 330; 430/124.1, 430/124.3, 124.32, 124.33
See application file for complete search history.

(56) References Cited

U.S. PATENT DOCUMENTS

| | | | | |
|---|---|---|---|---|
| 2011/0103854 | A1* | 5/2011 | Gervasi et al. | 399/333 |
| 2011/0274908 | A1* | 11/2011 | Kowata et al. | 428/297.4 |
| 2012/0094081 | A1* | 4/2012 | Kelly et al. | 428/172 |
| 2012/0181458 | A1* | 7/2012 | Leucht et al. | 250/519.1 |
| 2012/0224897 | A1* | 9/2012 | Qi et al. | 399/333 |

* cited by examiner

*Primary Examiner* — Sophia S Chen
(74) *Attorney, Agent, or Firm* — MH2 Technology Law Group LLP

(57) ABSTRACT

Exemplary embodiments provide materials and methods for a fuser member used in electrophotographic devices, wherein the fuser member can include an outermost layer containing a plurality of nanosized cellulosic particles dispersed in and/or bonded to a fluoropolymer matrix.

20 Claims, 3 Drawing Sheets

BIONANOCOMPOSITE FUSER TOPCOATS COMPRISING NANOSIZED CELLULOSIC PARTICLES

BACKGROUND

Conventional electrophotographic imaging processes typically include forming a visible toner image on a support surface (e.g., a sheet of paper). The visible toner image is often transferred from a photoreceptor that contains an electrostatic latent image and is usually fixed or fused onto the support surface using a fuser to form a permanent image. Conventional fusing apparatus include a fuser member and a pressure member, which may be configured to include a roll pair maintained in pressure contact or a belt member in pressure contact with a roll member. In a fusing process, heat may be applied by heating one or both of the fuser member and the pressure member.

One major failure mode for conventional fuser members includes paper-edge wear and scratch damage at the fuser surfaces due to lack of mechanical robustness of the fuser topcoat materials. The operating lifetime of fusers is then limited.

Conventional approaches for solving these problems include adding fillers into the fuser outermost materials. The fillers include carbon black, metal oxides, and carbon nanotubes (CNTs). However, the mechanical robustness and wear resistance still need to be improved in order to extend the short operating lifetime of conventional fusers. Additionally, there is an advantage to incorporating more mechanically flexible filler additives for the purpose of increasing toughness and reducing wear and scratch. Additionally, it is desirable to incorporate sustainable or biodegradable components based on renewable resources into printer members.

Thus, there is a need to overcome these and other problems of the prior art and to provide composite materials with suitable filler particles for fuser members.

SUMMARY

According to various embodiments, a fuser member is provided. The fuser member can include a substrate and an outermost layer disposed over the substrate. The outermost layer can include a plurality of nanosized cellulosic particles disposed in a fluoropolymer matrix, wherein each of the plurality of nanosized cellulosic particles comprises one or more of a microfibrillated cellulose (MFC) particle, a nanocrystalline cellulose particle, a MFC cluster, and combinations thereof.

According to additional embodiments, a fuser member and include a substrate and an outermost layer disposed over the substrate. The outermost layer can include a plurality of nanosized cellulosic particles disposed in a fluoropolymer matrix to provide the outermost layer with a tensile strength ranging from about 500 psi to about 5000 psi, wherein each of the plurality of nanosized cellulosic particles comprises one or more of a nanocrystalline cellulose (NCC) particle, a NCC cluster, and combinations thereof.

In further embodiments, a fusing method for improving gloss level in prints is provided. The method can include providing a fuser member comprising an outermost layer, the outermost layer comprising a plurality of nanosized cellulosic particles disposed in a fluoropolymer matrix to provide the outermost layer with an average surface roughness Sq value ranging from about 0 μm to about 20 μm. Each of the plurality of nanosized cellulosic particles can include one or more of a microfibrillated cellulose (MFC) particle, a MFC cluster, a nanocrystalline cellulose (NCC) particle, a NCC cluster, a MFC-NCC cluster, and combinations thereof. A contact arc can be formed between the outermost layer of the fuser member and a pressure member. A print medium comprising a toner image thereon can be passed through the contact arc to fuse the toner image on the print medium, wherein the outermost layer with the average surface roughness Sq value provides the toner image fused on the print medium a gloss level ranging from about 30 ggu to about 70 ggu.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1A:
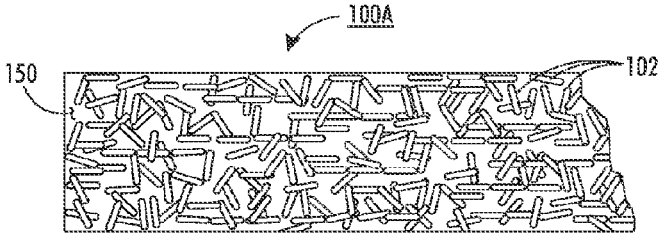
FIGS. 1A-1C depict various exemplary nanosized cellulosic particle-reinforced fluoropolymer composite materials in accordance with various embodiments of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the present teachings may be practiced. The following description is, therefore, merely exemplary.

Exemplary embodiments provide materials and methods for nanosized cellulosic particle-reinforced fluoropolymer composite materials used for fuser members in electrophotographic printing devices. The nanosized cellulosic particle-reinforced fluoropolymer composite materials can include nanosized cellulosic particles dispersed in and/or bonded to a fluoropolymer matrix. The nanosized cellulosic particle-reinforced fluoropolymer composite materials can be used as an outermost layer of a fuser member to provide desirable properties suitable for the fusing processes.

Nanobiocomposites in this case refer to polymers containing cellulosic fillers with at least one dimension smaller than 100 nm. In embodiments, the nanosized cellulosic particles can include microfibrillated cellulose (or MFC) particles and/or their clusters, nanocrystalline cellulose (or NCC) particles and/or their clusters, MFC-NCC clusters, and/or combinations thereof. In embodiments, the nanosized cellulosic particles can have at least one minor dimension, for example, width or diameter, of about 100 nanometers or less. The nanosized cellulosic particles can be in a form including, but not limited to, a flake, strand, whisker, rod, needle, shaft, pillar, and/or wire.

As used herein, the term "microfibrillated cellulose" or "MFC" refers to isolated and purified cellulose fibers recovered from a source in a process preserving the original cellulose filamentous structure. Also encompassed by this term can be cellulose fibers, which after isolation and purification have undergone chemical treatment changing the internal structure and/or arrangement of the fibers.

Consequently the term microfibrillated cellulose or MFC can encompass purified and isolated cellulose obtained from microorganisms such as bacterial cellulose.

In embodiments, the disclosed nanosized cellulosic particles can be different from conventional cellulose fibers due to the removal of lignin and hemicelluloses from the fibrous bundles but leaving cellulose strands. MFC particles can be obtained by extracting the fibrils from cellulose strands. With additional mechanical disintegration and defibrillation of the strands, long, flexible fibers containing crystalline portions linked together by non-crystalline portions can be obtained. In embodiments, the crystalline portion of a MFC particle can be from about 40 to about 75, or from about 50 to about 70, or from about 60 to about 65 in relative to the MFC particle. In embodiments, MFC particles themselves can have a dense network structure similar to cellulose molecules. MFC particles can also form a less dense network structure within a composite formulation, to thicken, gel, or reinforce the surrounding matrix.

In embodiments, an MFC particle can have an average diameter or equivalent diameter ranging from about 1 nm to about 100 nm, or from about 2 nm to about 50 nm, or from about 5 nm to about 20 nm, and an average length ranging from about 1 micron to about 100 microns, or from about 2 microns to about 40 microns, or from about 5 microns to about 20 microns. In embodiments, an MFC particle can have an average surface area ranging from about 0.002 microns$^2$ to about 30 microns$^2$, or from about 0.01 microns$^2$ to about 6 microns$^2$, or from about 0.1 microns$^2$ to about 1 microns$^2$, although the dimensions of the MFC particles are not limited.

In embodiments, nanocrystalline cellulose (NCC) can be formed by digesting and removing the flexible components of cellulose fibers but leaving the crystalline portion. In embodiments, an NCC particle can have an average diameter or equivalent diameter ranging from about 1 nm to about 70 nm, or from about 2 nm to about 50 nm, or from about 5 nm to about 20 nm, and an average length ranging from about 20 nm to about 3 microns, or from about 35 nm to about 1000 nm, or from about 50 nm to about 700 nm. In another embodiment, the surface-functionalized NCC particles may have an aspect ratio (length:width) of from about 2 to about 1000, or from about 3 to about 500, or from about 5 to about 350. In embodiments, an NCC particle is crystalline and containing few to no defects.

In embodiments, the nanosized cellulosic particles of MFC and/or NCC can encompass cellulosic derivatives including, but not limited to, cellulose esters, cellulose ethers, cellulose acids cellulose amines, and/or cellulose amides. The hydroxyl groups (—OH) of cellulosic particles can be readily reacted with various reagents to provide desired derivatives. For example, nanosized cellulosic particles can be readily reacted with various surfactant materials to tailor desirable properties useful for processing materials when forming the reinforced composite materials. Exemplary surfactant materials can include, but are not limited to phosphoric acids, ketones, ethers, esters, hydroxides, amines, and azides. In embodiments, the surfactant materials can be physically attached to the nanosized cellulosic particles.

In embodiments, the nanosized cellulosic particles of MFC and/or NCC can be physically dispersed in and/or chemically bonded to the fluoropolymer matrix.

As used herein, the nanosized cellulosic particles being "bonded" to a polymer matrix refers to chemical bonding such as ionic or covalent bonding, and not to weaker bonding mechanisms such as hydrogen bonding or physical entrapment of molecules that may occur when two chemical species are in close proximity to each other. For example, the nanosized cellulosic particles can be simply mixed or dispersed in the fluoropolymeric matrix, but is not chemically bonded to the fluoropolymer material. In another embodiment, the nanosized cellulosic particles can be chemically bonded to the fluoropolymer material, such as being crosslinked with the polymer material via covalent bonds. In still another embodiment, the nanosized cellulosic particles can have some particles that are simply mixed or dispersed in the fluoropolymer material, while other particles are chemically bonded to the fluoropolymer material.

The nanosized cellulosic particles of MFC and/or NCC can exhibit a strong hydrogen bonding power due to the —OH group on the surface thereof. MFC particles can interact with one another to form MFC clusters. NCC particles can interact with one another to form NCC clusters. MFC particles can also interact with NCC particles to form MFC-NCC clusters.

Figure 1B:
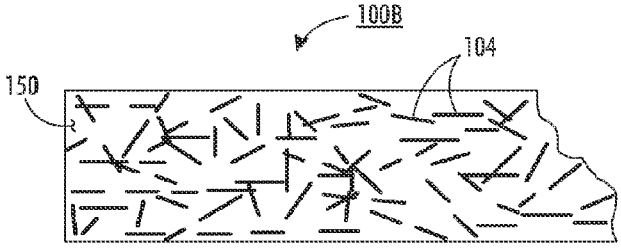
Figure 1C:
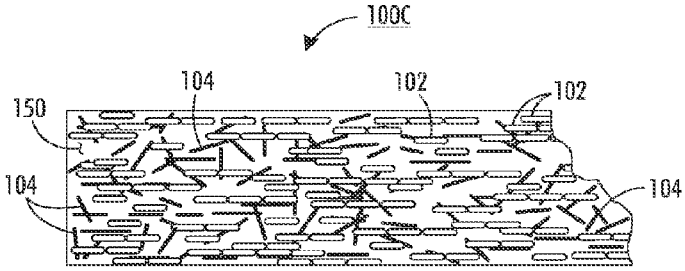

FIGS. 1A-1C depict various exemplary nanosized cellulosic particle-reinforced fluoropolymer composite materials in accordance with various embodiments of the present teachings.

In FIG. 1A, the composite material 100A can include a plurality of MFC particles 102, randomly or uniformly, dispersed in a fluoropolymer matrix 150. The MFC particles 102 can be non-agglomerated particles and/or can form MFC clusters in the fluoropolymer matrix 150. In embodiments, the MFC clusters can have an average cluster size ranging from about 1 micron to about 100 microns, or from about 5 microns to about 50 microns, or from about 10 microns to about 20 microns. In an exemplary embodiment, MFC particles can provide "web-like" reinforcement to the fluoropolymer matrix 150, for example, to improve mechanical strength of the composite material 100A while maintaining its flexibility.

In FIG. 1B, the composite material 100B can include a plurality of NCC particles 104, randomly or uniformly, dispersed in a fluoropolymer matrix 150. The NCC particles 104 can be non-agglomerated particles and/or can form NCC clusters in the fluoropolymer matrix 150. In embodiments, the NCC clusters can have an average cluster size ranging from about 1 micron to about 100 microns, or from about 5 microns to about 50 microns, or from about 10 microns to about 20 microns. NCC particles 104 can provide mechanical reinforcement to the fluoropolymer matrix 150.

In FIG. 1C, the composite material 100C can include both MFC particles 102 and NCC particles 104, which can be randomly or uniformly dispersed in a fluoropolymer matrix 150. The MFC particles 102 and/or NCC particles 104 can be non-agglomerated particles and/or can form MFC clusters, NCC clusters, and/or MFC-NCC clusters in the fluoropolymer matrix 150. In embodiments, the MFC-NCC clusters formed by MFC and NCC particles can have an average cluster size ranging from about 1 micron to about 100 microns, or from about 5 microns to about 50 microns, or from about 10 microns to about 20 microns. In the embodiments when both MFC particles and NCC particles are present in the reinforced composite material, a weight ratio of MFC to NCC can range from about 5 to 0.1, or from about 1 to 0.2, or from about 0.6 to 0.3.

In embodiments, nanosized cellulosic particles of MFC and/or NCC can be present in an amount ranging from about 1 to about 30, or from about 3 to about 10, or from about 5 to about 8 by weight of the total content of the reinforced composite materials 100A-C, wherein the number of combinations of the non-agglomerated and the clusters and/or the number of combinations of MFC particles 102 and NCC particles 104 contemplated by the present disclosure are not limited.

Various fluoropolymers can be used to provide the fluoropolymer matrix 150 for forming the composite materials 100A-C. The fluoropolymers can include, but are not limited to, fluoroelastomers, fluoroplastics, and/or fluororesins. In embodiments, other possible polymers including, for example, silicone elastomers, thermoelastomers, and/or resins can be incorporated or independently used for the polymer matrix.

Exemplary fluoroelastomers can include a monomeric repeat unit selected from the group consisting of tetrafluoroethylene (TFE), perfluoro(methyl vinyl ether), perfluoro(propyl vinyl ether), perfluoro(ethyl vinyl ether), vinylidene fluoride hexafluoropropylene, and a mixture thereof. The fluoroelastomers can also include a cure site monomer.

In specific embodiments, exemplary fluoroelastomers can be from the class of 1) copolymers of two of vinylidenefluoride (VDF or VF2), hexafluoropropylene (HFP), and tetrafluoroethylene (TFE); 2) terpolymers of vinylidenefluoride, hexafluoropropylene, and tetrafluoroethylene; and 3) tetrapolymers of vinylidenefluoride, hexafluoropropylene, tetrafluoroethylene, and cure site monomer. These fluoroelastomers are known commercially under various designations such as VITON A®, VITON B®, VITON E®, VITON E 60C®, VITON E430®, VITON 910®, VITON GH®; VITON GE®; and VITON ETP®. The VITON® designation is a Trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers can include FLUOREL 2170®, FLUOREL 2174®, FLUOREL 2176®, FLUOREL 2177® and FLUOREL LVS 76®, FLUOREL® being a registered trademark of 3M Company. Additional commercially available materials include AFLAS™ a poly(propylene-tetrafluoroethylene), and FLUOREL II® (LII900) a poly(propylene-tetrafluoroethylenevinylidenefluoride), both also available from 3M Company, as well as the Tecnoflons identified as FOR-60KIR®, FOR-LHF®, NM® FOR-THF®, FOR-TFS®, TH®, NH®, P757®, TNS®, T439®, PL958®, BR9151® and TN505®, available from Ausimont.

Examples of three known fluoroelastomers are (1) a class of copolymers of two of vinylidenefluoride, hexafluoropropylene, and tetrafluoroethylene, such as those known commercially as VITON A®; (2) a class of terpolymers of vinylidenefluoride, hexafluoropropylene, and tetrafluoroethylene known commercially as VITON B®; and (3) a class of tetrapolymers of vinylidenefluoride, hexafluoropropylene, tetrafluoroethylene, and cure site monomer known commercially as VITON GH® or VITON GF®.

The fluoroelastomers VITON GH® and VITON GF® have relatively low amounts of vinylidenefluoride. The VITON GE® and VITON GH® have about 35 weight percent of vinylidenefluoride, about 34 weight percent of hexafluoropropylene, and about 29 weight percent of tetrafluoroethylene, with about 2 weight percent cure site monomer.

Exemplary fluoroplastics can include, but are not limited to, polyfluoroalkoxypolytetrafluoroethylene (PFA), polytetrafluoroethylene (PTFE), and/or fluorinated ethylenepropylene copolymer (FEP). These fluoroplastics can be commercially available from various designations, such as TEFLON® PFA, TEFLON® PTFE, or TEFLON® FEP available from E.I. DuPont de Nemours, Inc. (Wilmington, Del.).

In embodiments, the nanosized cellulosic particles including MFC particles 102 and/or NCC particles 104 can be distributed within the fluoropolymer matrix 150 to substantially control or enhance physical properties, such as, for example, mechanical, chemical, and surface properties of the resulting polymer composite, as well as fusing performances and printing performances.

The nanosized cellulosic particle-reinforced fluoropolymer composite materials (see FIGS. 1A-1C) can have a tensile strength ranging from about 500 psi to about 5000 psi, or from about 1200 psi to about 2200 psi, or from about 1400 psi to about 1800 psi; a toughness ranging from about 500 in.-lbs./in.$^3$ to about 5000 in.-lbs./in.$^3$, or from about 1500 in.-lbs./in.$^3$ to about 4000 or from about 2400 in.-lbs./in.$^3$ to about 3000 in.-lbs./in.$^3$; and an initial modulus ranging from about 400 psi to about 3000 psi, or from about 500 psi to about 2000 psi, or from about 600 psi to about 1000 psi. In embodiments, the above-described mechanical properties can be measured using the ASTM D412 method as known in the art at a temperature of about 180° C.

In embodiments, the nanosized cellulosic particle-reinforced fluoropolymer composite materials (see FIGS. 1A-1C) can provide desirable surface roughness, for example, ranging from about 0 μm to about 20 μm, or from about 1 μm to about 10 μm, or from about 3 μm to about 5 μm. This surface roughness can facilitate control of image gloss levels when used in fusing process.

The nanosized cellulosic particle-reinforced fluoropolymer composite materials (see FIGS. 1A-1C) can be used as an outermost layer of a fuser member in a variety of fusing subsystems. The fuser member can be in a form of, for example, a roll, a drum, a belt, a drelt, a plate, or a sheet. For example, FIGS. 2A-2B depict exemplary fuser rolls in accordance with various embodiments of the present teachings.

Figure 2A:
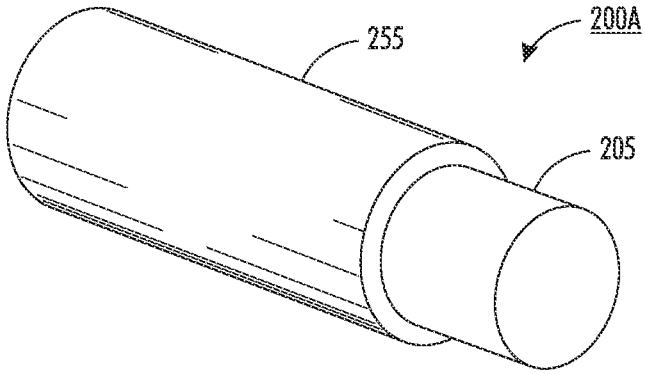
FIGS. 2A-2B depict exemplary fuser members including the composite materials of FIGS. 1A-1C in accordance with various embodiments of the present teachings.
Figure 2B:
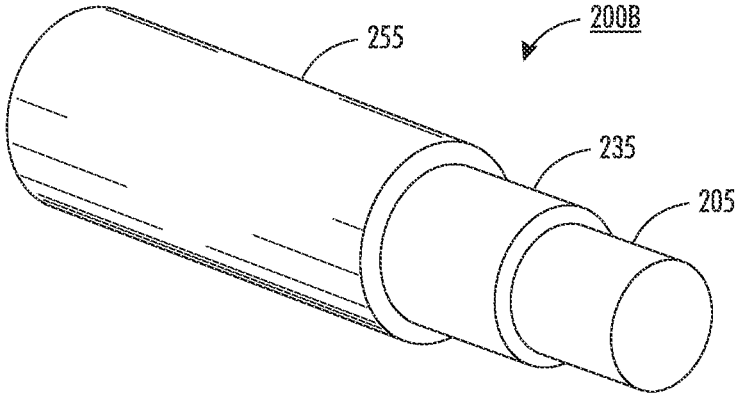

As shown in FIGS. 2A-2B, the exemplary fuser rolls 200A-B can include a substrate 205 and an outermost layer 255 formed over the substrate 205.

The substrate 205 can be made of a material including, but not limited to, a metal, a plastic, and/or a ceramic. For example, the metal can include aluminum, anodized aluminum, steel, nickel, and/or copper. The plastic can include polyimide, polyester, polyetheretherketone (PEEK), poly (arylene ether), and/or polyamide. As illustrated, the substrate 205 can take the form of, e.g., a cylindrical tube or a solid cylindrical shaft, although one of the ordinary skill in the art would understand that other substrate forms, e.g., a belt or a film substrate, can be used to maintain rigidity and structural integrity of fuser members.

The outermost layer 255 can include, for example, the nanosized cellulosic particle-reinforced fluoropolymer composite materials 100A-C as shown in FIGS. 1A-1C. The outermost layer 255 can thus include a plurality of nanosized cellulosic particles dispersed in and/or bonded to the fluoropolymer matrix 150. In embodiments, the outermost layer 255 can have a thickness ranging from 5 μm to about 100 μm, or from about 10 μm to about 50 μm, or from about 20 μm to about 40 μm.

As shown in FIG. 2A, the outermost layer 255 can be formed directly on the substrate 205. In other embodiments, a base layer 235 can be formed between the outermost layer 255 and the substrate 205. The base layer 235 can include one or more functional layers including, but not limited to, an elastomer layer, an intermediate layer, and/or an adhesive layer.

For example, the elastomer layer of the base layer 235 can be formed of materials including, isoprenes, chloroprenes, epichlorohydrins, butyl elastomers, polyurethanes, silicone elastomers, fluorine elastomers, styrene-butadiene elastomers, butadiene elastomers, nitrile elastomers, ethylene propylene elastomers, epichlorohydrin-ethylene oxide copolymers, epichlorohydrin-ethylene oxide-allyl glycidyl ether copolymers, ethylene-propylene-diene (EPDM) elastomers, acrylonitrile-butadiene copolymers (NBR), natural rubber, and the like, or combinations thereof.

Figure 3:
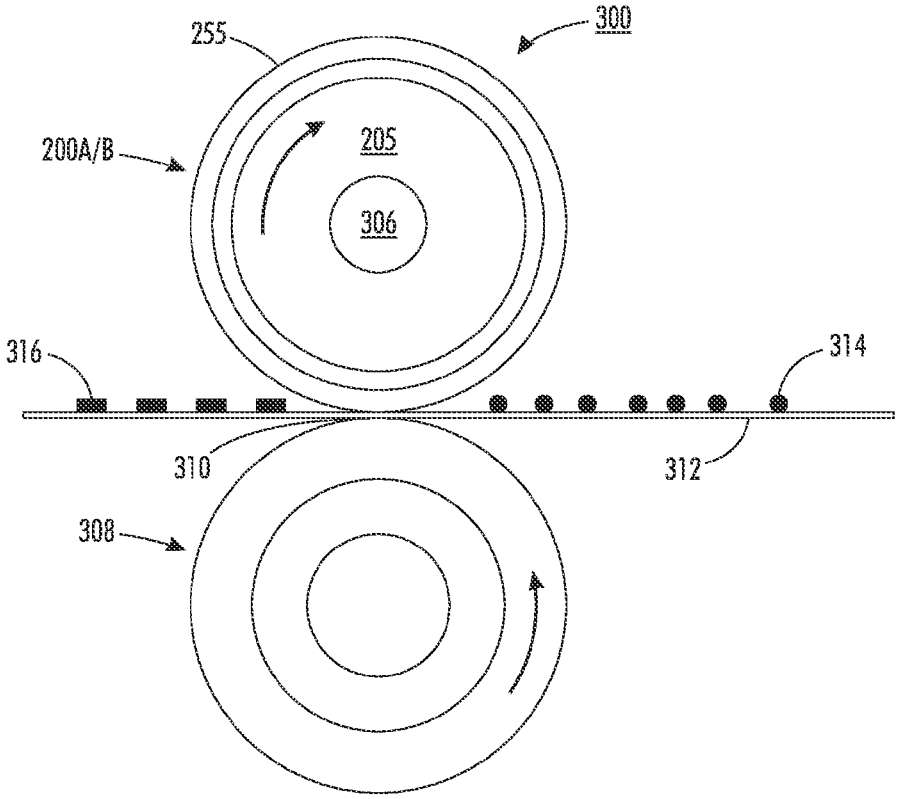
FIG. 3 depicts an exemplary fusing method using the fuser members of FIGS. 2A-2B in accordance with various embodiments of the present teachings.

The exemplary fuser member 200A/B can be used in a conventional fusing system to improve fusing performances. FIG. 3 depicts an exemplary fusing system 300 using the disclosed member 200A or 200B of FIGS. 2A-2B.

The exemplary system 300 can include the exemplary fuser roll 200A or 200B having an outermost layer 255 over a suitable substrate 205. The substrate 205 can be, for example, a hollow cylinder fabricated from any suitable metal. The fuser roll 200A/B can further have a suitable heating element 306 disposed in the hollow portion of the substrate 205 which is coextensive with the cylinder. Backup or pressure roll 308, as known to one of ordinary skill in the art, can cooperate with the fuser roll 200A/B to form a nip or contact arc 310 through which a print medium 312 such as a copy paper or other print substrate passes, such that toner images 314 on the print medium 312 contact the outermost layer 255 during the fusing process. The fusing process can be performed at a temperature ranging from about 60° C. (140° F.) to about 300° C. (572° F.), or from about 93° C. (200° F.) to about 232° C. (450° F.), or from about 160° C. (320° F.) to about 232° C. (450° F.). Optionally, a pressure can be applied during the fusing process by the backup or pressure roll 308. Following the fusing process, after the print medium 312 passing through the contact arc 310, fused toner images 316 can be formed on the print medium 312.

As disclosed herein, the gloss output of the fused toner images 316 on the print medium 310 can be controlled by using the nanosized cellulosic particle-reinforced fluoropolymer composite materials 100A-C as the outermost layer of the fuser member. Depending on the polymers and particles selected for the composites, suitable levels of image gloss can be obtained as desired. The gloss level can be measured by a digital high-precision glossmeter (manufactured by Murakami Color Research Laboratory Co., Ltd.) at an incident angle of 75°. The measured gloss level is therefore referred to as G75 gloss level, as known to one of ordinary skill in the art. For example, conventional fuser materials produce images with a gloss level greater than 80 ggu in iGen configurations, while the exemplary fuser materials can produce images with controllable, e.g., reduced, gloss level of the fused or printed images of less than about 70 ggu, for example, in a range from about 30 ggu to about 70 ggu, or from about 40 ggu to about 65 ggu, or from about 50 ggu to about 60 ggu.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

EXAMPLES

Example 1

Dispersion of NCC in a Fluoroelastomer

A fluoroelastomer composite was prepared as follows: about 0.5 grams of approximately 150 nm nanocrystalline cellulose whiskers and about 50 grams of Viton GF (available from E. I. du Pont de Nemours, Inc.) were mixed at about 170° C. using a twin screw extruder at a rotor speed of about 20 revolutions per minute (rpm) for about 20 minutes to form a polymer composite containing about 1 pph of NCC nanoparticles. A similar procedure was used to prepare two other fluoroelastomer composites with 3 pph and 10 pph of NCC nanoparticles respectively.

Example 2

Preparation of a Top-Coat Layer

Three coating compositions containing NCC composite from Example 1 were prepared, each containing 17 weight percent fluoroelastomer composites dissolved in methyl isobutylketone (MIBK) and combined with 5 pph (parts per hundred versus weight of VITON® GF) AO700 crosslinker (aminoethyl aminopropyl trimethoxysilane crosslinker from Gelest) and 24 pph Methanol. The coating compositions were coated onto three aluminum substrates with a barcoater and the coatings were cured via stepwise heat treatment over about 24 hours at temperatures between 49° C. and 177° C.

Example 3

Alternative Dispersion of NCC in a Fluoroelastomer and Preparation of a Top-Coat Layer A fluoroelastomer composite was prepared as follows: about 0.06 grams of approximately 150 nm nanocrystalline cellulose whiskers were dispersed in about 10 g of methyl isobutylketone (MIBK) by milling with 3 mm diameter steel balls for 24 hours. The resulting NCC dispersion was then combined with a separate dispersion of about 2 g Viton GF (available from E. I. du Pont de Nemours, Inc.) dispersed in about 10 g of methyl isobutylketone (MIBK), then with 5 pph (parts per hundred versus weight of VITON®-GF) AO700 crosslinker (aminoethyl aminopropyl trimethoxysilane crosslinker from Gelest) and 24 pph Methanol. The composite coating composition was coated onto an aluminum substrates with a barcoater and the coating was cured via stepwise heat treatment over about 24 hours at temperatures between 49° C. and 177° C.

Example 4

Dispersion of MFC in a Fluoroelastomer and Preparation of a Top-Coat Layer

A fluoroelastomer composite was prepared as follows: about 0.06 grams of approximately 10 micron microfillibrated cellulose particles are dispersed in about 10 g of methyl isobutylketone (MIBK) by milling with 3 mm diameter steel balls for 24 hours. The resulting MFC dispersion is then combined with a separate dispersion of about 2 g Viton GF (available from E. I. du Pont de Nemours, Inc.) dispersed in about 10 g of methyl isobutylketone (MIBK), then with 5 pph (parts per hundred versus weight of VITON®-GF) AO700 crosslinker (aminoethyl aminopropyl trimethoxysilane crosslinker from Gelest) and 24 pph Methanol. The composite coating composition is coated onto an aluminum substrates with a barcoater and the coating was cured via stepwise heat treatment over about 24 hours at temperatures between 49° C. and 177° C.

Example 5

Dispersion of NCC in a Fluoroplastic

A coating formulation is prepared by dispersing MP320 powder PFA from DuPont (particle size greater than 15 microns) and approximately 150 nm nanocrystalline cellulose whiskers in 2-propanol with a total solids loading of 20 weight percent. Dispersion of the components in 2-propanol is aided by repeated sonnication. Dispersions are then sprayed onto a silicone rubber substrate using a Paashe airbrush. The coatings are cured by heat treatment at 350° C. for 15-20 minutes to form a composite film.

While the invention has been illustrated respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the phrase "one or more of", for example, A, B, and C means any of the following: either A, B, or C alone; or combinations of two, such as A and B, B and C, and A and C; or combinations of three A, B and C.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A fuser member comprising:

a substrate; and an outermost layer disposed over the substrate, the outermost layer comprising a plurality of nanosized cellulosic particles disposed in a fluoropolymer matrix, wherein each of the plurality of nanosized cellulosic particles comprises one or more of a microfibrillated cellulose (MFC) particle, a nanocrystalline cellulose particle, a MFC cluster, and combinations thereof, wherein the outermost layer has an average surface roughness Sq value ranging from about 0 μm to about 20 μm.

2. The member of claim 1, wherein the outermost layer has an average surface roughness Sq value ranging from about 1 μm to about 10 μm.

3. The member of claim 2, wherein the outermost layer has an average surface roughness Sq value ranging from about 3 μm to about 5 μm.

4. The member of claim 1, wherein the MFC particle has an average diameter ranging from about 1 nm to about 100 nm, an average length ranging from about 1 micron to about 100 microns, and an average surface area ranging from about 0.002 microns$^2$ to about 30 microns$^2$.

5. The member of claim 1, wherein the MFC particle comprises a crystalline portion and a non-crystalline portion, wherein the crystalline portion is about 60% to about 65% relative to the MFC particle.

6. The member of claim 1, wherein the MFC cluster is formed by a plurality of MFC particles and has an average cluster size ranging from about 10 microns to about 20 microns.

7. The member of claim 1, wherein each of the plurality of nanosized cellulosic particles further comprises one or more of a nanocrystalline cellulose (NCC) particle, a NCC cluster, a MFC-NCC cluster, and a combination thereof, and wherein a weight ratio of MFC to NCC ranges from about 0.6 to about 0.3.

8. The member of claim 1, wherein the plurality of nanosized cellulosic particles are present in an amount ranging from about 1% to about 30% by weight of the total outermost layer.

9. The member of claim 1, wherein the fluoropolymer matrix comprises a fluoroplastic selected from the group consisting of a polytetrafluoroethylene, a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), and a combination thereof.

10. The member of claim 1, wherein the fluoropolymer matrix comprises a fluoroelastomer comprising a cure site monomer and a monomeric repeat unit selected from the group consisting of a vinylidene fluoride, a hexafluoropropylene, a tetrafluoroethylene, a perfluoro(methyl vinyl ether), a perfluoro(propyl vinyl ether), a perfluoro(ethyl vinyl ether), and a combination thereof.

11. A fuser member comprising:

a substrate; and an outermost layer disposed over the substrate, the outermost layer comprising a plurality of nanosized cellulosic particles disposed in a fluoropolymer matrix to provide the outermost layer with a tensile strength ranging from about 500 psi to about 5000 psi, wherein each of the plurality of nanosized cellulosic particles comprises one or more of a nanocrystalline cellulose (NCC) particle, a NCC cluster, and a combinations, wherein the outermost layer has an average surface roughness Sq value ranging from about 0 μm to about 20 μm.

12. The member of claim 11, wherein the outermost layer has a tensile strength ranging from about 1200 psi to about 2200 psi.

13. The member of claim 12, wherein the outermost layer has a tensile strength ranging from about 1400 psi to about 1800 psi.

14. The member of claim 11, wherein the NCC particle has an average diameter ranging from about 1 nm to about 70 nm, an average length ranging from about 20 nm to about 3 microns, and an average aspect ratio ranging from about 5 to about 350.

15. The member of claim 11, wherein the NCC cluster is formed by a plurality of NCC particles and has an average cluster size ranging from about 10 microns to about 20 microns.

16. The member of claim 11, wherein the plurality of nanosized cellulosic particles further comprises one or more of a microfibrillated cellulose (MFC) particle, a MFC cluster, a MFC-NCC cluster and a combination thereof, wherein a weight ratio of MFC to NCC ranges from about 5 to about 0.1.

17. The member of claim 11, wherein the substrate is a cylinder, a roller, a drum, a belt, a plate, a film, a sheet, or a drelt, and wherein the substrate is formed of a material selected from the group consisting of a metal, a plastic, a ceramic, and combinations thereof.

18. A fusing method for improving gloss level in prints comprising:

providing a fuser member comprising an outermost layer, the outermost layer comprising a plurality of nanosized cellulosic particles disposed in a fluoropolymer matrix to provide the outermost layer with an average surface roughness Sq value ranging from about 0 μm to about 20 μm, wherein each of the plurality of nanosized cellulosic particles comprises one or more of a microfibrillated cellulose (MFC) particle, a MFC cluster, a nanocrystalline cellulose (NCC) particle, a NCC cluster, a MFC-NCC cluster, and a combination thereof;

forming a contact arc between the outermost layer of the fuser member and a pressure member; and passing a print medium comprising a toner image thereon through the contact arc to fuse the toner image on the print medium, wherein the outermost layer with the average surface roughness Sq value provides the toner image fused on the print medium a gloss level ranging from about 30 ggu to about 70 ggu.

19. The method of claim 18, wherein the fused toner image on the print medium has a gloss level in a range between about 40 ggu and about 65 ggu.

20. The method of claim 19, wherein the fused toner image on the print medium has a gloss level in a range between about 50 ggu and about 60 ggu.

* * * * *